US005184999A

United States Patent [19]

Vigano'

[11] Patent Number: 5,184,999

[45] Date of Patent: Feb. 9, 1993

[54] DEVICE AND PROCESS FOR THE PRESSING OF SHEETS DURING FOLDING

[75] Inventor: Vittorio Vigano', Verdellino, Italy

[73] Assignee: Coly S.A.R.L., Brignais, France

[21] Appl. No.: 738,967

[22] Filed: Aug. 1, 1991

[30] Foreign Application Priority Data

Aug. 3, 1990 [IT] Italy ..... 21191 A/90

[51] Int. Cl.[5] ..... B65H 45/16

[52] U.S. Cl. ..... 493/435

[58] Field of Search ..... 493/424, 434, 435, 442, 493/454, 471, 469, 476; 29/121.6, 123, 125, 130

[56] References Cited

U.S. PATENT DOCUMENTS

| | | | |
|---|---|---|---|
| 279,114 | 6/1883 | Adams | 493/435 |
| 349,391 | 9/1886 | Godfrey | 493/435 |
| 1,663,763 | 3/1928 | Johnson | 493/354 |
| 4,375,971 | 3/1983 | Moll | 493/442 |

FOREIGN PATENT DOCUMENTS

| | | | |
|---|---|---|---|
| 2618258 | 1/1977 | Fed. Rep. of Germany | 493/454 |

*Primary Examiner*—Bruce M. Kisliuk
*Assistant Examiner*—Jack Lavinder
*Attorney, Agent, or Firm*—Browdy and Neimark

[57] ABSTRACT

Device for the pressing of sheets during folding, including a first roller (2*a*) and a second roller (2*b*) which are positioned opposite each other and have rotation axes (3*a*, 3*b*) which are parallel to each other, and first permanent magnets (13*a*) engaged to the first roller (2*a*) and second permanent magnets (13*b*) engaged to the second roller (2*b*), the first permanent magnets (13*a*) and the second permanent magnets (13*b*) having opposite polarities facing each other. The process consists in applying mutual approach forces to the rollers which decrease as the distance between the same rollers increases.

8 Claims, 2 Drawing Sheets

FIG. 3
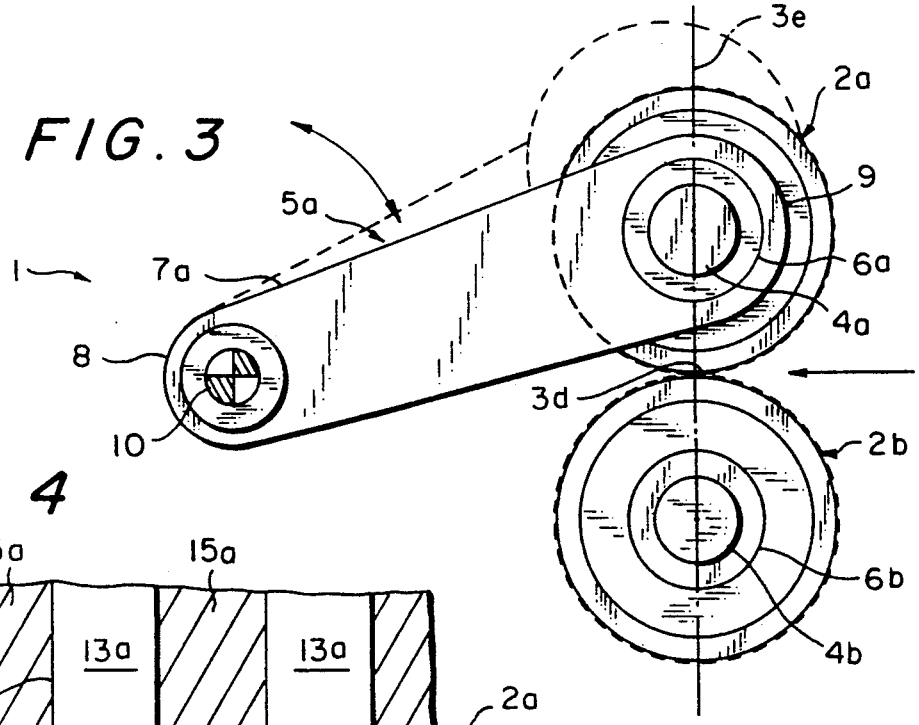
FIG. 4
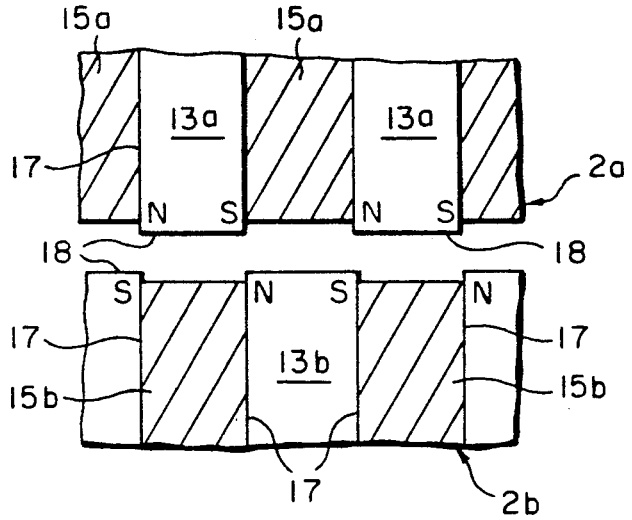
FIG. 5
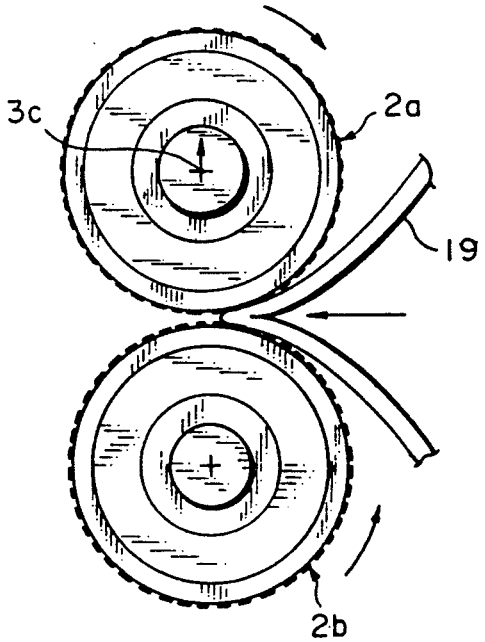
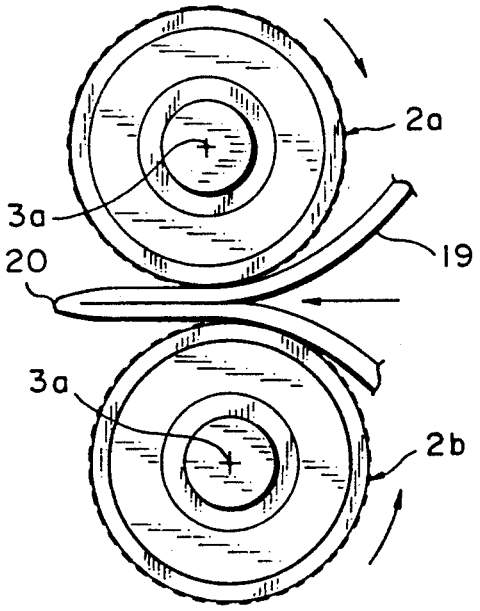
FIG. 6

DEVICE AND PROCESS FOR THE PRESSING OF SHEETS DURING FOLDING

BACKGROUND OF THE INVENTION

The present invention has for its subject matter a device and a process for the pressing of sheets during folding. As it is known, in the production of a book, a booklet or similar items such as, for example, geographical maps and brochures, it is necessary to fold preprinted sheets of two or more pages over themselves.

To carry out and complete such folding, which must be clear and precise, couples of press rollers are used placed opposite one another with parallel rotation axes. These rollers are of a rather complex construction since they must respond to precise and severe requirements: they must be able to sustain considerable forces theoretically without yielding and present very reduced radial tolerances, in such a way that there are no variations in pressure and tangential velocity along their axes, variations which would give rise to irregular feeding and folding between the various areas of the sheets themselves.

In fact the rollers are subject to heavy mutual approach pressure which is necessary to obtain a neat fold line on the sheets.

The pressure between the two rollers is obtained by means of springs or fluid dynamic cylinders which act on the ends of the rollers, outwith the work area of the same, and by means of restraining reactions again acting correspondingly on the ends of the rollers.

On the contrary, the folded sheets, of various dimensions and thickness, enter centrally between the rollers. It follows that the force of the sheets which tend to push the rollers apart is opposed not where it occurs, but at points distant from each other.

In practice there are inevitably moments when the rollers tend to yield and the pressure exerted by these cannot therefore be uniform transversally to the direction of feeding of the sheets.

Furthermore, the pressing forces in pushing apart the rollers tend to increase since as the elastic elements which determine the approaching of the rollers become more deformed, the more these same pressing forces exerted by them increase.

SUMMARY OF THE INVENTION

In this situation, the technical aim which is at the origin of this invention is to conceive a device and a process for the pressing of sheets during folding which is able to solve the technical problem of yielding of the folding rollers generated by the passage between them of the folded sheets. The technical aim is substantially achieved by a device for the pressing of sheets during folding, including at least two rollers, placed opposite each other and defining a first roller and a second roller both rotating and having rotation axes parallel to each other, the device further including, in said rollers, permanent magnets having first permanent magnets engaged to said first roller and second permanent magnets engaged to said second roller, said first permanent magnets and said second permanent magnets having opposite polarities facing each other.

The process for the pressing of sheets during folding, between two rollers having parallel rotation axes, placed opposite one another and mobile in terms of mutual approaching and distancing, consists in applying a reciprocal approach forces to said rollers which decrease as the distance between said rollers increases.

BRIEF DESCRIPTION OF THE DRAWINGS

There will now follow, as a non-limiting example, the description of preferred embodiment of a device and a process according to the invention shown in the enclosed drawings, in which:

FIG. 3 is a lateral view of the device in FIG. 1;

FIG. 4 shows a part of the device in larger scale;

FIGS. 5 and 6 show successive phases of pressing of a folded sheet.

DETAILED DESCRIPTION OF THE INVENTION

Figure 1:
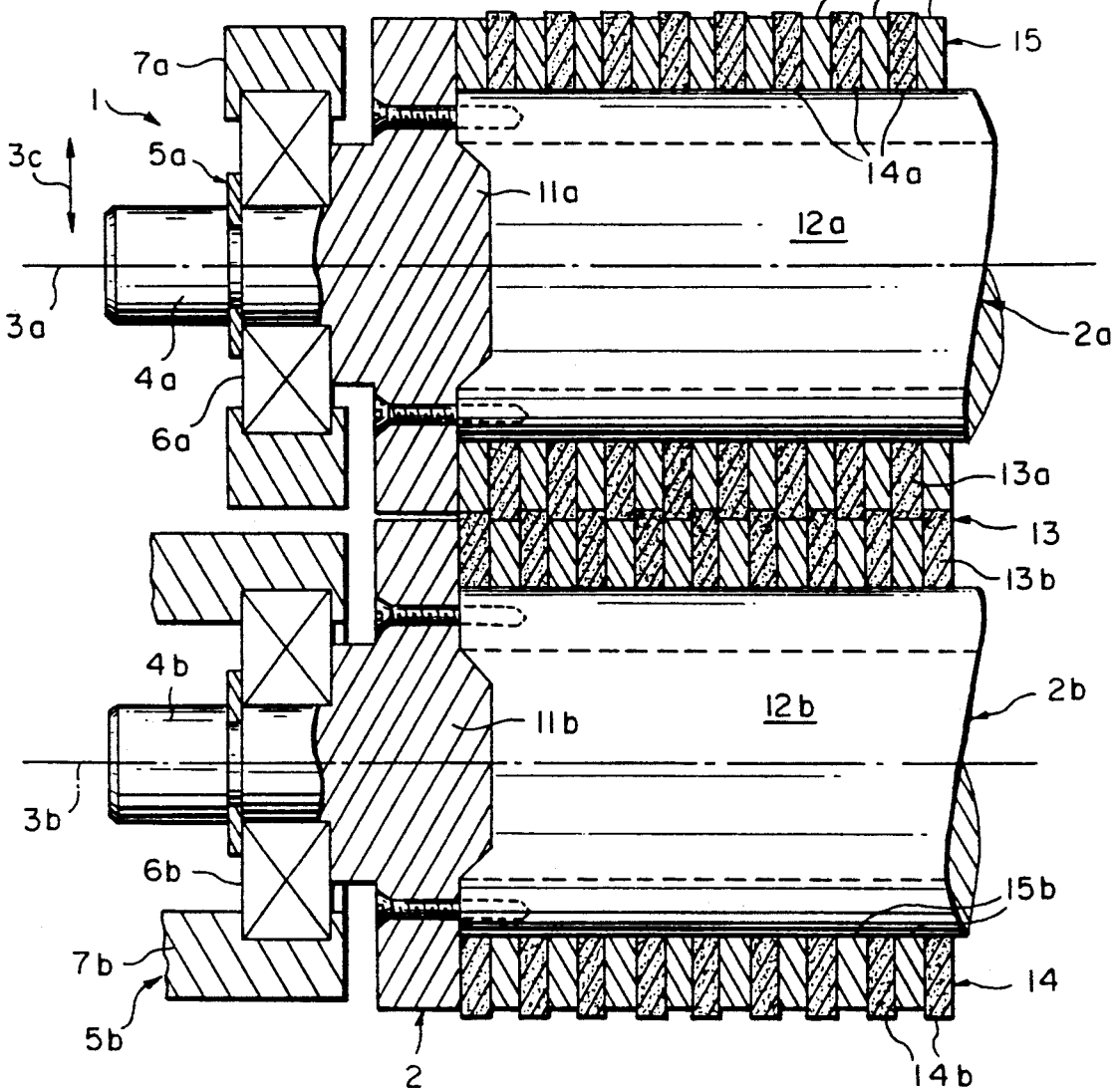
FIG. 1 shows a partial longitudinal cross-section of a device according to the invention.

With reference to the Figures mentioned, the device according to the invention is generally indicated with the number 1.

It includes at least two rollers 2 indicated by a first and a second roller **2*a* and 2*b*, held opposite each other by support elements 5*a*, 5*b* which follow rotation axes indicated respectively by a first and a second rotation axis 3*a* and 3*b*** which are parallel to each other.

The first roller **2*a* can oscillate in position and is supported, at first ends 4*a*, by first support elements 5*a* including first rolling contact bearings 6*a*, preferably for different loads, of the truncated conical section type or equivalent, and mobile supports 7*a*, substantially made from bars rotatably engaged to a fixed pivot 10, at a first end section 8 thereof, on the opposite side from a second end section 9 in which one rolling contact bearing 6*a* is placed (FIG. 3**).

The mobile supports **7*a* have an oscillation direction 3*c* for the first roller 2*a* which is transversal to the rotation axes 3*a* and 3*b* and further prevent considerable movement of the first roller 2*a* in a direction parallel to its rotation axis 3*a***.

The second roller **2*b* fixed in position, is engaged at second ends 4*b*, by second support elements 5*b* including second rolling contact bearings 6*b*, for various loads, and fixed supports 7*b***.

The rollers **2*a* and 2*b* have, engaged at ends 4*a* and 4*b*, respectively a first and second flange 11*a* and 11*b*, and a first and second cylindrical central core 12*a* and 12*b*. Around the central cores 12*a* and 12*b* permanent magnets 13 are placed: in particular, first permanent magnets 13*a* on the first roller 2*a* and second permanent magnets 13*b* on the second roller 2*b***.

These permanent magnets are placed in such a way as to realize magnetic zones 14 which are separate from each other on each of the rollers: first magnetic zone **14*a* on the roll 2*a* and second magnetic zone 14*b* on the roll 2*b***.

In fact, it is foreseen that the magnetic zones **14*a*, 14*b* are alternated, on each of the rollers and in the development direction of the rotation axes 3*a* and 3*b*, with spacing zones 15, without permanent magnets, and comprising first spacing zones 15*a* obtained on the first rollers 2*a*, and second spacing zones 15*b* obtained on the second rollers 2*b*. Furthermore, the magnetic zones 14*a*, 14*b* are realized by magnetic rubber or similar material having in its surface little surface relief, appendices or projections 16** having low elasticity.

Preferably the magnetic rubber is an anistrotopic plastic magnet named "plastomag" and obtained by a mixture of Ferroxdure powder with sythetic rubber.

Each of the magnetic zones 14*a* and 14*b* is preferably realized by a single disc or permanent magnet 13*a* and 13*b*, developing in transversal planes to the rotation axes 3*a*, 3*b* and with a very flattened disc profile, with a thickness of for example between two and seven millimeters, in parallel to the rotation axes.

This thickness remains substantially constant and the discs or permanent magnets 13*a*, 13*b* are thus delimited by plane edge faces 17, perpendicular to the rotation axes, and by a fine annular strip 18 placed on the external surface, substantially cylindrical, of the respective rollers 2 and parallel and concentric to the respective rotation axes. It is possible to use discs or permanent magnets 13*a*, 13*b* which are different from each other, for example with annular strips 18 of different polarity. However, the preferred technical solution teaches a specific magnetisation: each annular strip 18 develops between two opposite polarities and in particular the outside circumferential edges of the strips 18, where they meet with face 17, have opposite polarities.

Furthermore, in each roller 2, the permanent magnets 13 are equally oriented to each other and the outside edges of the strips 18 having the same polarity are directed towards a same end of the respective roller 2, with respect to a median zone of the same strips 18.

This situation is advantageous in that it allows setting of permanent magnets which are all equal to each other and also to obtain considerable mutual autopositioning of the rollers 2*a*, 2*b*, parallel to their rotation axes, given that even slight axial movements results in a major relative movement with respect to the magnetised zones.

FIG. 4 shows a further characteristic of the preferred technical solution: both the first permanent magnets 13*a* of the first roller 2*a* and the second permanent magnets 13*b* of the second roller 2*b* are equally oriented and the ends of the strip 18 with the same polarity are all set in the same direction.

Therefore the permanent magnets 13 of the two rollers are out of phase with each other in the axial direction and the first spacing zones 15*a* face the second permanent magnets 13*b*, while the second spacing zones 15*b* face the first permanent magnets 13*a*.

This situation is advantageous in that the surface projections 16 can direct themselves to zones free from the same, the spacing zones 15*a*, 15*b* and therefore create light undulations on the folded papers which is useful for preventing creases. The magnetisation of the magnetic rubber is preferably limited substantially to the surface section of the discs or magnets, but may also refer to the whole surface of faces 17.

In this case it is particularly important that the cores 12*a*, 12*b* are in material impermeable to magnetic fields, to avoid the closing of magnetic fields within the rollers. The surface projections 16 emerge from the annular strips 18 and develop right across the width of the strips.

Figure 2:
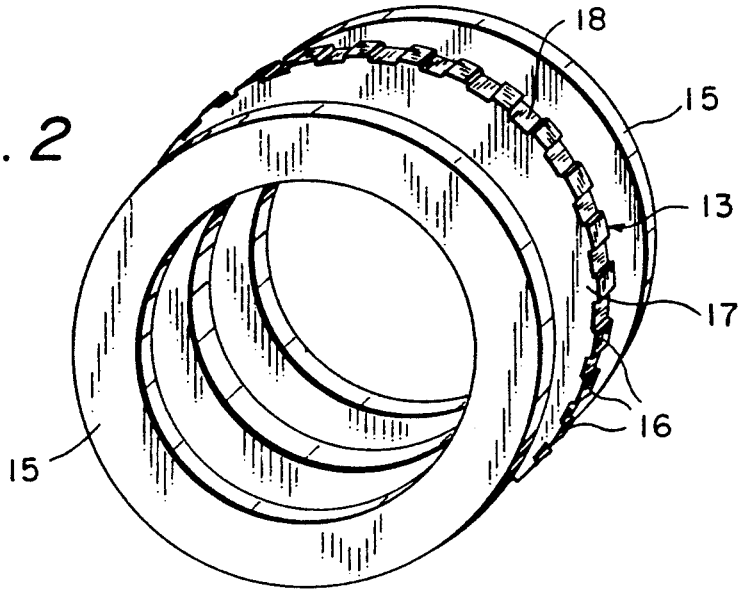
FIG. 2 shows a perspective view of several components of the device in FIG. 1.

In transversal section to the rotation axes 3*a*, 3*b* the surface projections 16 have a predetermined and constant profile, e.g. with steps, in order to establish on the whole some small blocks, as shown in FIG. 2.

In fact the thinness of the permanent magnets 13*a*, 13*b* also has the advantage that it makes it possible a fulfilment by cutting or shearing of the surface projections 16 in direction parallel to the rotation axes.

The surface projections 16 raise up even only by a fraction of a millimeter from the annular strips 18 and can also have a tooth or rod or tapered shape in a radial direction. Even the spacing zones 15*a*, 15*b* are all equal to each other and made from flattened discs with a general shape similar to that of the permanent magnets, as shown in FIG. 2. Thanks to the setting of the permanent magnets, all equally positioned and directing each other opposite polarities, on a same roller, the first and the second spacing zones 15*a* and 15*b* can be made in materials which are substantially permeable to the magnetic fields of the adjacent magnetic zones or in substantially impermeable material.

This makes it possible to vary the attraction between the rollers 2*a*, 2*b*: a material which can be crossed by magnetic force field lines gives rise to pressing forces which are largely reduced, while a material which does not permit the passage of magnetic force field lines gives rise to a higher attraction force value between the rollers, given that these tend to close only between magnets belonging to different rollers.

Furthermore, still keeping all of the preferred solutions regarding magnetisation and position of the permanent magnets, it is possible to make the same permanent magnets perfectly smooth whilst making the spacing zones in rubber or similar, or coating of the same, having surface projections similar to those indicated by 16 in the drawings. In practice the structure of the device is still that indicated in FIGS. 1 and 2, except that the permanent magnets are indicated by 15*a*, 15*b* while the spacing zones are indicated by 13*a* and 13*b*.

Finally in the drawings a sheet folded back on itself is indicated under 19, and the folding of the sheet by 20. The operation of the device is as follows.

The sheet 19 is introduced between the rollers 2*a* and 2*b*. As soon as it reaches the contact zone of these the desired folding is carried out and completed.

The disposition of the magnetic zone gives rise to a strong attraction between the opposite polarities of the first permanent magnets 13*a* and the second permanent magnets 13*b*: the approach forces between the two rollers 2 are therefore distributed along the whole length of their line of contact. At each point the pressing force has the same value and the same rollers are not substantially subjected to flexure.

The feeding of the sheet causes the roller 2*a* to distance itself from roller 2*b* for a distance equal to the thickness of the folded sheet. The forces of magnetic attraction thus tend to decrease rapidly since it is known that their variation is inversely proportional to the square of the distance between the magnets.

If more reduced pressing forces are desired a material would be used for the first and second spacing zones 15*a*, 15*b* that can be crossed over by the magnetic field force lines in such a way that these can close, at least partially, between the main faces of polarity opposite to the adjacent magnetic zones of the same roller.

If on the other hand it is preferably to maintain a higher attraction force value between the rollers 2 and therefore the pressing force for the sheet 18, a material would be used for the spacing zones mentioned above which do not allow the magnetic force lines to pass, in such a way that these tend to close principally between the poles of opposite sign of the permanent magnets belonging to different rollers.

In practice, the choice will be dictated by the expected thickness of the folded sheets: for reduced thickness it is worth reducing the forces of attraction.

Even the thickness of the permanent magnets 13*a*, 13*b* will be chosen, between the indicated limits of around 2–7 millimeters, in direct proportion to the force to be exerted and to the thickness of the folded sheet.

In any case the two rollers, given the structure of the magnets, will tend to maintain a correct axial position, given that any axial movement will interfere with the magnetic actions.

Therefore even a very fine sub-division of rollers 2*a*, 2*b* in thin magnetic discs does not cause any problems in operation and on the contrary the rolling contact bearings 6*a*, 6*b* can be of economic type, as the plays of the same ones are not determining factors in the satisfactory operation of the device.

The surface projections 16, being flexible, limit the distancing of the rollers due to the impulses received by sheet 19 which is inserted, and above all limit the insertion shock of the same sheet and the resultant vibrations of the rollers. Furthermore, they contribute to prevent the formation of irregularities of folding making the sheet 19 slightly, due to the slight bendings imposed. The device described above carries out a new process. To the parallel rollers 2, placed opposite one another and mobile in terms of approching and distancing themselves from one another, a mutual approach force is applied, which force decreases with the distance between the rollers, on the contrary to the current situation.

Furthermore these forces are highly decreasing: they decrease in proportion to the square of the distance between the rotation axes 3*a*, 3*b* and in practice at a certain distance they are practically unobservable.

Thus, while the maximum force is applied to obtain the initial fold 20, as shown in FIG. 5, after the formation of the fold and the insertion of the folded sheet 19 between the roller, the pressure is reduced to a minimum and the folded sheet can thus advance without efforts (FIG. 6). Therefore, it is possible to avoid the danger of formation of creases, the danger of rumpling, and the danger of producing marks in the case where the inks are not perfectly dry or there are internal reliefs.

Said forces are applied by distributing them at least one generatrix 3*d*, that is the straight line generating the cylindrical surface of said roller laying in a plane 3*e* defined by the axes of the rollers themselves, in order to avoid any danger of flexure of the rollers even in the case of thick folded sheets of small dimensions in plane view, and therefore using only a portion of the rollers 2.

The application of these distributed forces is obtained by means of permanent magnets which are shaped by shearing. The permanent magnets are discoidal and thin in magnetic rubber: in this situation the magnetic rubber is shaped by shearing or by cutting in a direction parallel to the rotation axes in order to present surface projections on the external surface which has the typical feature that they go along the whole thickness of the discoidal elements.

The shearing has the advantage that it allows working of the rubber pieces which form the magnetic rubber, and it allows the production of surface projections of any appropriate profile in section.

The invention achieves important advantages. In fact the absence of elastic elements or springs makes the device able to fold a sheet perfectly with a constant and uniformly distributed folding pressure without the need for any kind of regulation or gauging.

The rollers are simple and can be simply and easily modified in terms of the size of the individual elements of which they are comprised, in such a way that it is possible to obtain the perfect solution in every situation.

The device and the process operate in the opposite direction to that of known devices, which achieve the maximum pressing force when the rollers are slightly distanced and not at the input of the same sheets, that is at the zone which should effectively be pressed in order to achieve the desired folds. The application of the maximum pressure after the insertion can give rise to the undesired phenomena of deformation and crinkling of the sheets.

I claim:

1. Device for the pressing of sheets during folding, comprising: at least two rollers (2), placed opposite each other and including a first roller (2*a*) and a second roller (2*b*) both rotating and having rotation axes (3*a*, 3*b*) with the length of each said rotation axes parallel to each other, said device further comprising, in said at least two rollers (2), permanent magnets (13) having first permanent magnets (13*a*) engaged to said first roller (2*a*) and second permanent magnets (13*b*) engaged to said second roller (2*b*), said first permanent magnets (13*a*) and said second permanent magnets (13*b*) having opposite polarities facing each other, said first permanent magnets (13*a*) and said second permanent magnets (13*b*) delineating magnetic zones (14*a*, 14*b*) which alternate with spacing zones (15*a*, 15*b*) along said length of each of said rotation axes (3*a*, 3*b*).

2. Device according to claim 1, in which said rollers (2) have substantially cylindrical external surfaces, in which said magnetic zones (14*a*, 14*b*) on said external surfaces form annular strips (18) each having two circumferential outer edges of opposite polarities, and in which in each of said rollers (2) said magnetic zones (14*a*, 14*b*) have said outer edges of equal polarities equally oriented.

3. Device according to claim 2, in which each of said at least two rollers (2) said magnetic zones (14*a*, 14*b*) have said outer edges of equal polarities identically oriented, and in which said spacing zone (15*a*) of said first roller (2*a*) are faced with said magnetic zones (14*b*) of said second roller (2*b*).

4. Device according to claim 3, in which said permanent magnets (13) are made from magnetic rubber and have surface projections (16) having low elasticity.

5. Device according to claim 4, in which said permanent magnets (13) are disc-shaped with a thickness between two and seven millimeters, in a direction parallel to said rotation axes (3*a*, 3*b*), and in which each of said surface projections (16) extends across said thickness, said surface projections (16) being shaped by shearing of said permanent magnets (13) parallel to said rotation axes (3*a*, 3*b*).

6. Device according to claim 3, in which said spacing zones (15*a*, 15*b*) are made from a material which is substantially permeable to a magnetic field of said magnetic zones (14*a*, 14*b*).

7. Device according to claim 3, in which said spacing zones (15*a*, 15*b*) are made from a material which is substantially impermeable to a magnetic field of said magnetic zones (14*a*, 14*b*).

8. Device according to claim 3, in which said spacing zones (15*a*, 15*b*) have surface projections (16) having low elasticity.

* * * * *